US007263860B2

(12) United States Patent
Okuno

(10) Patent No.: US 7,263,860 B2
(45) Date of Patent: Sep. 4, 2007

(54) KNITTING METHOD OF TUBULAR KNITTED FABRIC WITH PROJECTION, AND TUBULAR KNITTED FABRIC WITH PROJECTION

(75) Inventor: Masao Okuno, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/574,969

(22) PCT Filed: Oct. 7, 2004

(86) PCT No.: PCT/JP2004/014838

§ 371 (c)(1),
(2), (4) Date: Apr. 7, 2006

(87) PCT Pub. No.: WO2005/035848

PCT Pub. Date: Apr. 21, 2005

(65) Prior Publication Data

US 2007/0051137 A1 Mar. 8, 2007

(30) Foreign Application Priority Data

Oct. 10, 2003 (JP) ..... 2003-353019

(51) Int. Cl.
*D04B 7/04* (2006.01)

(52) U.S. Cl. ..... 66/64

(58) Field of Classification Search ..... 66/64, 66/60 R, 61, 69

See application file for complete search history.

(56) References Cited

U.S. PATENT DOCUMENTS

| | | | | |
|---|---|---|---|---|
| 5,299,435 | A * | 4/1994 | Whalley | 66/61 |
| 6,151,922 | A * | 11/2000 | Shimasaki | 66/61 |
| 6,581,417 | B2 * | 6/2003 | Yui | 66/176 |
| 6,655,175 | B1 * | 12/2003 | Okamoto | 66/69 |
| 2003/0010068 | A1 * | 1/2003 | Yui | 66/64 |

FOREIGN PATENT DOCUMENTS

| | | | |
|---|---|---|---|
| JP | 1-201554 | A | 8/1989 |
| JP | 10-140446 | A | 5/1998 |
| JP | 3061334 | U | 6/1999 |
| JP | 2002-146654 | A | 5/2002 |
| JP | 2003-13341 | A | 1/2003 |
| JP | 2003-221766 | A | 8/2003 |

* cited by examiner

*Primary Examiner*—Danny Worrell
(74) *Attorney, Agent, or Firm*—Rothwell, Figg, Ernst & Manbeck

(57) ABSTRACT

The present invention provides a knitting method of a tubular knitted fabric with a projection part having stretch and a supporting performance and formed in an arbitrary shape and at an arbitrary location by using a flat knitting machine. The method comprises the step 1 of knitting a knitted fabric in a tubular form joined at both ends of a knitting width by a rib knitting, while inserting an elastic yarn in the tubular body by an inlay, and the step 2 of knitting only a part for the projection part to be formed on at least either of a front side of the tubular knitted fabric and a back side of the same by a flechage knitting, the step 1 and the step 2 being repeatedly carried out.

5 Claims, 3 Drawing Sheets

KNITTING METHOD OF TUBULAR KNITTED FABRIC WITH PROJECTION, AND TUBULAR KNITTED FABRIC WITH PROJECTION

BACKGROUND OF THE INVENTION

1. Field of the Invention

The present invention relates to a knitting method of a tubular knitted fabric with projections, such as a sock, a supporter, and the like, using a flat knitting machine, and to a tubular knitted fabric knitted by the same knitting method.

2. Description of the Related Art

Elastic underwear having stretch and having a capability of providing a massage effect on a human body is known (Patent Document 1). In this elastic underwear, a plain knitted fabric part is knitted as a base knitted fabric part and an elastic yarn is weaved in it by the inlay. In the base knitted fabric part, a so-called float knitted fabric part is mixed wherein wales are produced by putting knitting needles in an operative mode to successively form loops in the wales and wales of various sizes are produced by putting the knitting needles in an inoperative mode for a predetermined course, not to form loops of the wales for the predetermined course. When one puts on this elastic underwear, vertical columns of loops formed by the float knitted fabric part serve as projections to provide a massage effect on the one's body. Also, a knitted fabric with projections applicable to a supporter and the like to produce a massage effect and an anti-slip effect is known (Patent Document 2). This knitted fabric is produced by using a circular knitting machine, according to which some courses are formed by putting certain needles of the knitting needles used for the knitting the knitted fabric in their inoperative positions, so that after the knitting, loops of the courses adjacent to a cored knitting yarn in the inoperative position are shrunk to produce projections on the back side of the knitted fabric, so as to provide the effects mentioned above. In addition to the knitting methods outlined above, yet another knitting method is also known according to which a projection part is previously formed as a separate part and the projection part is attached to the knitted fabric by sewing or by patching.

However, since any of the knitted fabrics mentioned above includes the plain knitted fabric part as the base knitted fabric part, even when the elastic yarn is weaved in the plain knitted fabric part by the inlay, it is hard for such a knitted fabric to provide a high supporting performance. In addition, the projection forming part is knitted with the knitting needles selectively put in the operative mode or in the inoperative mode during the formation of a course circularly knitted. In other words, the knitting of the projection forming part is integrally included in the process of knitting a tubular knitted fabric, so that the knitting process of the tubular knitted fabric and the knitting process of the projection forming part are not separated from each other. Hence, this knitting is sometimes subjected to various restrictions when the projection forming part is formed at an arbitrary location on the knitted fabric and in an arbitrary shape. Also, the knitting method wherein the projection part is separately formed and then is attached in the knitted fabric by sewing or patching at a later stage requires complicated works at the later stage and thus high production costs.

Patent Document 1: JP Laid-open (Unexamined) Patent Publication No. 2003-13341, and Patent Document 2: JP Laid-open (Unexamined) Patent Publication No. 2002-146654

SUMMARY OF THE INVENTION

In consideration of the actual circumstances mentioned above, the present invention has been made. It is an object of the present invention to provide a knitting method of a tubular knitted fabric with a projection part which has stretch and a supporting performance and can be formed at an arbitrary location and in an arbitrary shape, and a tubular knitted fabric knitted by the same method.

The present invention provides a knitting method of a tubular knitted fabric with a projection part having stretch and a supporting performance by using a flat knitting machine having at least a pair of front and back needle beds extending in a traverse direction and disposed opposite to each other in a cross direction, at least either of which is capable of being racked in the traverse direction so that loops can be transferred between the front and back needle beds, the method comprising:

the step 1 of knitting a knitted fabric in a tubular form joined at both ends of a knitting width by a rib knitting, while inserting an elastic yarn in the tubular body by an inlay, and the step 2 of knitting only a part for the projection part to be formed on at least either of a front side of the tubular knitted fabric and a back side of the same by a flechage knitting, the step 1 and the step 2 being repeatedly carried out.

In the knitting method of the present invention, it is preferable that the tubular body and the projection part are knitted using an elastic yarn.

Also, the present invention provides a tubular knitted fabric having a projection part having stretch and a supporting performance by using a flat knitting machine, wherein the tubular knitted fabric is knitted in a tubular form joined at both ends of a knitting width by a rib knitting, while inserting an elastic yarn in the tubular body by an inlay, and has the projection part formed on at least either of a front side of the tubular knitted fabric and a back side of the same by a flechage knitting.

In the tubular knitted fabric of the present invention, the projection part can be formed in an arbitrary shape and at an arbitrary location on the tubular knitted fabric by the flechage knitting.

In the tubular knitted fabric of the present invention, the projection part can be formed in an area extending in a course extending direction thereof and having courses different in number of stitches.

The knitting method of a tubular knitted fabric of the present invention can knit a knitted fabric which requires stretch and a supporting performance, such as e.g. a supporter, in the form of a seamless tubular body by using a flat knitting machine. Further, it can allow the projection part to be formed at an arbitrary location on a knitted fabric surface of the tubular body. Hence, when one puts on such a tubular knitted fabric, the tubular knitted fabric having the projection part can provide an improved massage effect, anti-slip effect, and impact absorbing effect for one's body. Also, since the knitted fabric is knitted in the form of a seamless tubular body, the need for a sewing process can be eliminated. In addition to this, since the projection part is knitted in parallel with the tubular body, the need for the process that the projection part to provide the effects mentioned above is previously formed as a separate part and the projection part is attached to the knitted fabric by sewing or patching can be eliminated to provide laborsaving. Also, since the tubular body is designed as the rib knitting structure and also an elastic yarn is inserted in that tubular body by the inlay, the tubular body can obtain required stretch and supporting performances. Additionally, since only the projection part forming area is knitted by the flechage knitting, the knitting can be carried out with efficiency as a whole. Further, since the knitting of the tubular base knitted fabric and the knitting of the projection part are carried out by the independent processes, respectively, the knitting of the projection part can be carried out with a high design freedom.

When not only the tubular body of the rib knitting structure but also the projection part are knitted using the elastic yarn, the tubular body having the projection part can be produced with further improved stretch and supporting performances.

Also, the projection part can be formed with efficiency by the flechage knitting and can be formed in an arbitrary shape and at an arbitrary location on the tubular knitted fabric.

Further, when the knitted fabric, such as a heel supporter and a knee supporter, is designed to have a fitting portion corresponding in shape to the heel or the knee, the tubular body comes to have courses different in number of stitches. However, according to the present invention, the projections can be arranged in even such a location.

DETAILED DESCRIPTION OF THE INVENTION

Next, a preferred embodiment of the present invention will be described with reference to the accompanying drawings.

Figure 1:
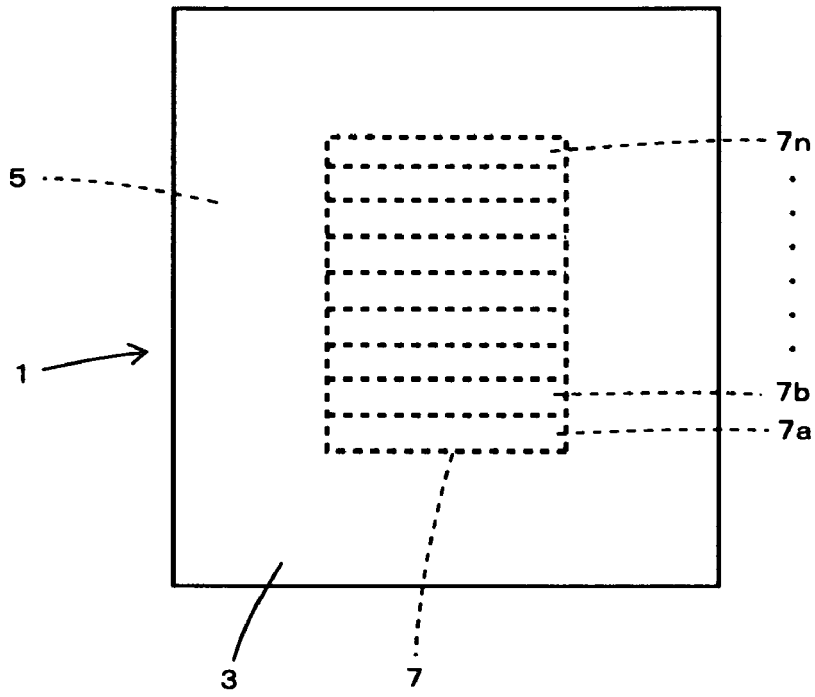
FIG. 1 is a plan view of a supporter knitted in the illustrated embodiment.

FIG. 1 is a plan view of a supporter 1 knitted in this embodiment. A front knitted fabric part 3 of a tubular knitted fabric has a projection part 7 at the inside thereof. The tubular knitted fabric part has a two-color rib jacquard structure in which an elastic yarn is inserted by the inlay. In this embodiment, a group of rows of projections is referred to as the projection part.

While a knitting method using a two-bed knitting machine is described in this embodiment, the knitting can also be carried out using a four-bed knitting machine comprising an upper front needle bed, a lower front needle bed, an upper back needle bed, and a lower back needle bed.

Figure 2:
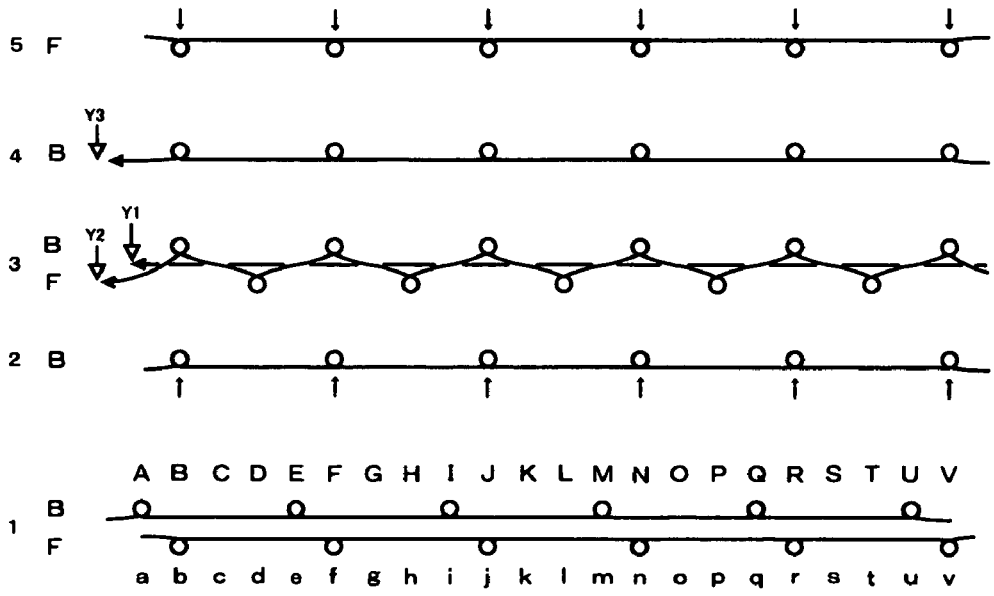
FIG. 2 is a knitting process drawing of a base knitted fabric of the supporter knitted in the illustrated embodiment.
Figure 3:
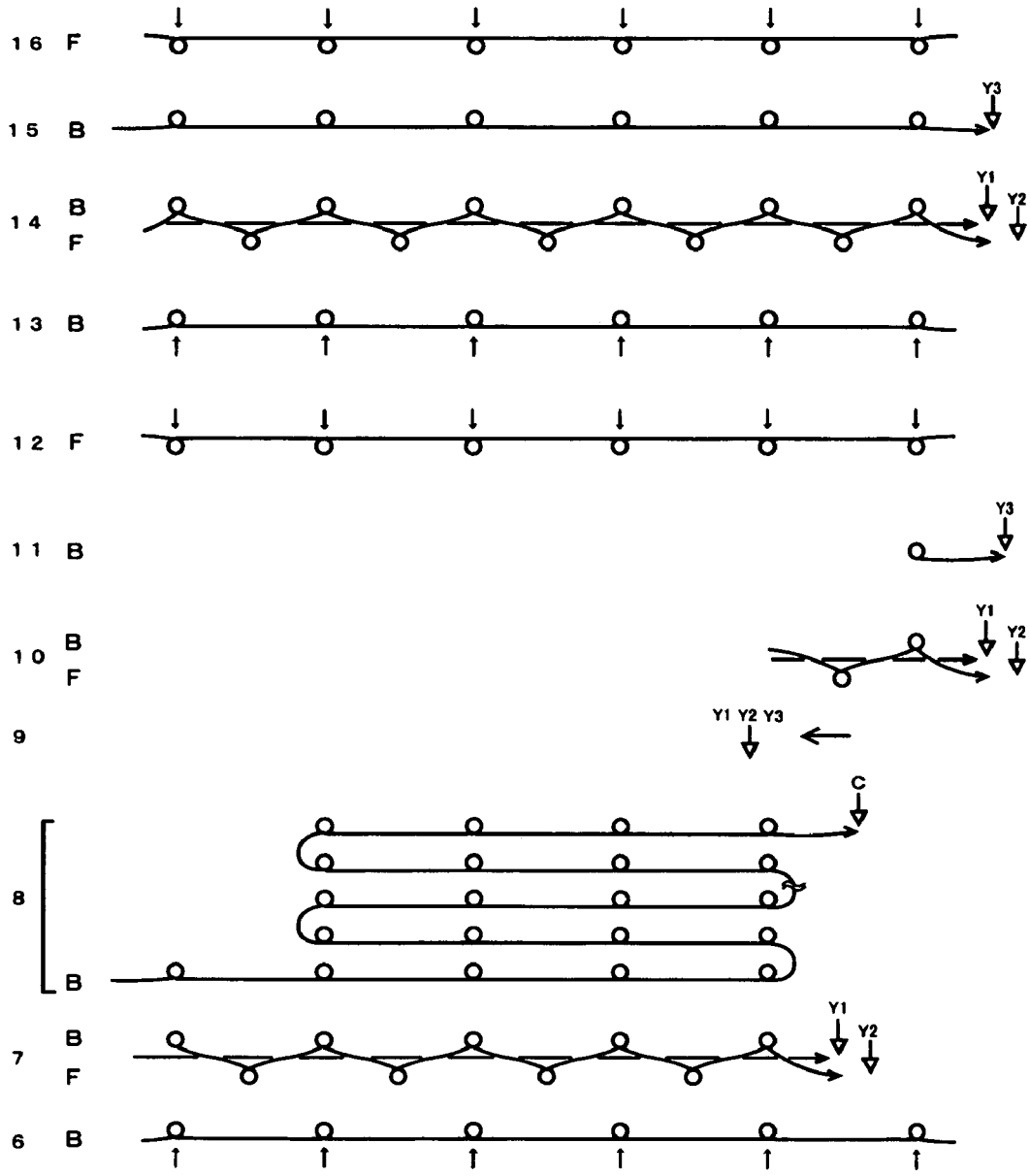
FIG. 3 is a knitting process drawing of rows of projections of the supporter knitted in the illustrated embodiment.

FIG. 2 shows a knitting process of a base knitted fabric of FIG. 1, and FIG. 3 shows a knitting process of rows of projections of FIG. 1. For convenience and simplification of explanation, only the knitting of only a surrounding area of a projection forming part 7 of the front knitted fabric 3 is described. The back knitted fabric 5 is knitted to have the same two-color rib jacquard structure.

A yarn feeder Y1 is used to feed to needles an elastic yarn for the inlay knitting, and yarn feeders Y2 and Y3 are used to feed to needles a stretch wooly nylon for the knitting of the rib jacquard structure. Also, an elastic yarn feeding device is additionally provided in the flat knitting machine so that the elastic yarn for the inlay knitting can be fed in the tensed state.

Step 1 shows the state in which loops of the front knitted fabric 3 and loops of the back knitted fabric 5 are held on the front and back needle beds, respectively, when a tubular knitted fabric is knitted using a two-bed flat knitting machine in such a manner that the two-color rib jacquard structure is knitted on an every four needle basis.

As to the knitting processes after the step 2, reference is just given to the knitting of the front knitted fabric 3 held on the front needle bed. After the step 2, reference is given to the process of knitting the two-color rib jacquard structure on an every four needle basis from the state of Step 1.

Loops b, f, j, n, r, v held on the front needle bed are transferred to knitting needles B, F, J, N, R, V of the back needle bed (Step 2).

The elastic yarn of the yarn feeder Y1 is fed by the inlay. Sequentially, the rib knitting is performed on an every four needle basis using the yarn feeder Y2 (Step 3).

Loops are formed with knitting needles B, F, J, N, R, V of the back needle bed, using the yarn feeder Y3 (Step 4). Then, those loops are transferred back to the knitting needles b, f, j, n, r, v of the front needle bed (Step 5).

In the front knitted fabric 3, the base knitted fabric of the two-color rib jacquard structure is knitted by repeating the above-said steps 2 to 5 a prescribed number of times.

Then, reference is given to the processes of knitting rows of projections with knitting needles F, J, N, R of the back needle bed. The loops b, f, j, n, r, v held on the front needle bed are transferred to the knitting needles B, F, J, N, R, V of the back needle bed (Step 6).

The elastic yarn of the yarn feeder Y1 is fed by the inlay, followed by the rib knitting on an every two or more needle basis using the yarn feeder Y2 (Step 7).

Loops are formed with the knitting needles B, F, J, N, R, of the back needle bed, using the yarn feeder Y3. Thereafter, a flechage knitting is performed a prescribed number of times, using the needles F, J, N, R (Step 8). It is needless to say that as the number of times the flechage knitting is performed increases, the rows of projections increase in height, and as the knitting width within which the flechage knitting is performed increases, the rows of projections increase in width.

Then, the yarn feeders Y1, Y2, and Y3 are kicked back to the inside of the knitted fabric (Step 9). Thereafter, the elastic yarn of the yarn feeder Y1 is fed by the inlay, followed by the rib knitting on an every two or more needle basis using the knitting needles t, V (Step 10).

A loop is formed with the knitting needle V of the back needle bed, using the yarn feeder Y3 (Step 11). Then, the loops B, F, J, N, R, V held on the back needle bed are transferred back to the knitting needles b, f, j, n, r, v of the front needle bed (Step 12).

The loops b, f, j, n, r, v held on the front needle bed are transferred to knitting needles B, F, J, N, R, V of the back needle bed (Step 13).

The elastic yarn of the yarn feeder Y1 is fed by the inlay, followed by the rib knitting on an every two or more basis using the yarn feeder Y2 (Step 14).

Loops are formed with the knitting needles B, F, J, N, R, V of the back needle bed, using the yarn feeder Y3 (Step 15). Then, those loops are transferred back to the knitting needles b, f, j, n, r, v of the front needle bed (Step 16).

A row of projections 7*a* is formed on the inside of the front knitted fabric 3 of the tubular knitted fabric by the knitting process from Step 6 to Step 16 described above. When the knitting process from Step 6 to Step 16 proceeds repeatedly, rows of projections 7*b* to 7*n* are formed sequentially and thereby the projection part 7 comprising a group of rows of projections is formed. For the purpose of forming a certain base knitted fabric part between adjacent rows of projections, a knitting process from Step 2 to Step 5 may be inserted in the knitting process described above.

After completion of the knitting of the projection part 7, the knitting process from Step 2 to Step 5 is repeated again to knit the base knitted fabric of the two-color rib jacquard structure. The supporter 1 is knitted in the manner described above.

Figure 4:
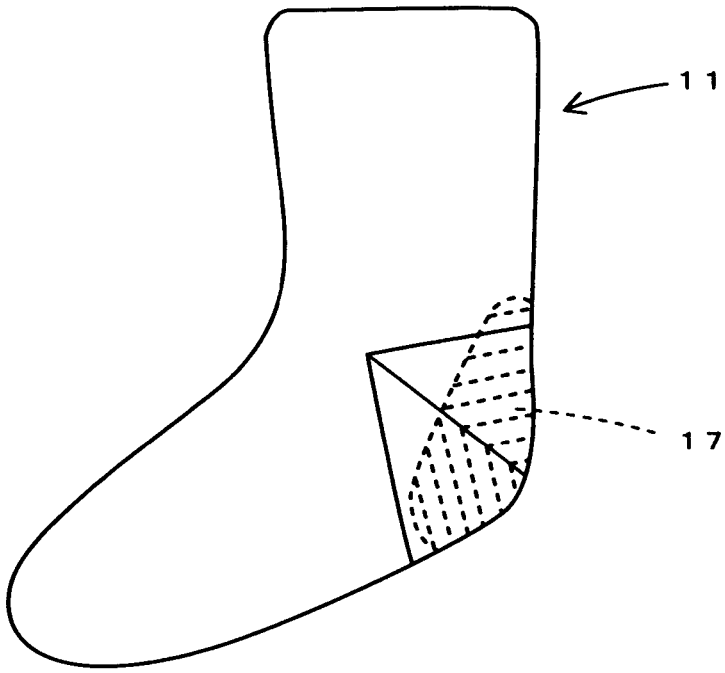
FIG. 4 is a plan view of an impact absorbing heel supporter, and FIG. 5 us a plan view of a knee supporter.

In the embodiment illustrated above, the projection part is formed to have repeated rows of projections of equal in width and height. Alternatively, the projection part may be formed by voluntary combination of the rows of projections of widths varied and those of heights varied by changing the number of times the flechage knitting is carried out. FIG. 4 shows an impact-absorbing heel supporter 11. A heel part of the base knitted fabric is formed in a shape corresponding to the heel by the flechage knitting. A projection part 17 comprising various rows of projections of different lengths is arranged in the tubular knitted fabric to extend over the front and back knitted fabrics of the heel part.

Figure 5:
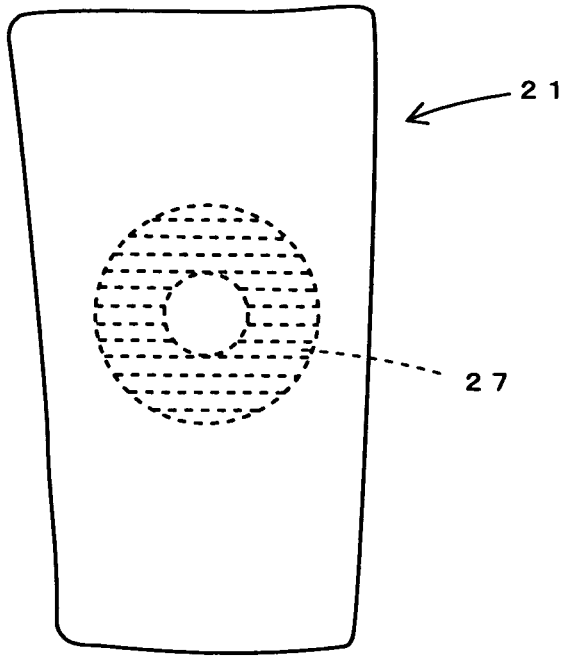

The knitting process from Step 6 to Step 16 may proceed in any selective area on the tubular knitted fabric. In the case of an elbow or heel supporter, the projection part can be formed in a doughnut shape in an area of the supporter contacting with the joint of elbow or heel. The projection part may be arranged in, for example, a staggered pattern or a checkered pattern, in addition to in the doughnut shape. FIG. 5 shows a knee supporter 21 having a doughnut-shaped projection part and a base knitted fabric part formed in a center of the doughnut-shaped projection part.

In the knitting of the rows of projections, the rows of projections varied in height in a widthwise direction thereof can be formed when the knitting width is gradually reduced every time that the flechage knitting is carried out.

In the knitting of the rows of projections, an area where projections are formed and an area where no projections are formed may be mixed in a row of projections by the needles used for forming loops and the needles used for forming no loops being arranged correspondingly. The projection part in a doughnut shape, a staggered pattern, or a checkered pattern can also be obtained in this manner.

In the embodiment mentioned above, the rows of projections are formed on the inside surface of the front knitted fabric using the knitting needles F, J, N, R of the back needle bed. When the projection part is formed on the outside surface of the front knitted fabric, the yarn is fed to the knitting needles f, j, n, r of the front needle bed in Step 8, to form the rows of projections with those knitting needles. The projection part may be formed on both the inside surface and the outside surface of the front knitted fabric. When the projection part on the inside surface and the projection part on the outside surface are formed at different locations, the rows of projections may be formed in the projection parts, respectively, using the knitting needles on the respective needle beds on the respective sides on which the respective projection parts are wanted to be formed. On the other hand, when the projection part on the inside surface and the projection part on the outside surface are formed at corresponding locations, that may be accomplished by the process that a row of projections on one side is knitted, then, at least one course of the base knitted fabric is knitted, and then a row of projections on the other side is knitted, these knitting process being repeatedly carried out, to form the projection parts. When a row of projections is formed on the inside surface using, for example, the needles F, N and a row of projections is formed on the outside surface using, for example, the needles j, r, the respective rows of projections are held using the knitting needles holding loops of the base knitted fabric. Thus, the rows of projections on the inside surface and the rows of projections on the outside surface can be formed simultaneously by the manner mentioned above.

The tubular knitted fabric having the projection part of the present invention, having stretch and a supporting performance, is widely applicable to various supporters, including, for example, a massage-use supporter, a medical-use supporter, and a sport-use supporter.

Explanation of Letters or Numerals

| | | | |
|---|---|---|---|
| 1 | Supporter, | 3 | Front knitted fabric |
| 5 | Back knitted fabric | 7 | Projection part |
| 11 | Heel supporter | 17 | Projection part |
| 21 | Knee supporter | 27 | Projection part |

The invention claimed is:

1. A knitting method of a tubular knitted fabric with a projection part having stretch and a supporting performance by using a flat knitting machine having at least a pair of front and back needle beds extending in a traverse direction and disposed opposite to each other in a cross direction, at least either of which is capable of being racked in the traverse direction so that loops can be transferred between the front and back needle beds, the method comprising:

the step 1 of knitting a knitted fabric in a tubular form joined at both ends of a knitting width by a rib knitting, while inserting an elastic yarn in the tubular body by an inlay, and the step 2 of knitting only a part for the projection part to be formed on at least either of a front side of the tubular knitted fabric and a back side of the same by a flechage knitting, the step 1 and the step 2 being repeatedly carried out.

2. The knitting method of the tubular knitted fabric according to claim 1, wherein the tubular body and the projection part are knitted using an elastic yarn.

3. A tubular knitted fabric having a projection part having stretch and a supporting performance by using a flat knitting machine having at least a pair of front and back needle beds extending in a traverse direction and disposed opposite to each other in a cross direction, at least either of which is capable of being racked in the traverse direction so that loops can be transferred between the front and back needle beds, wherein the tubular knitted fabric is knitted in a tubular form joined at both ends of a knitting width by a rib knitting, while inserting an elastic yarn in the tubular body by an inlay, and has the projection part formed on at least either of a front side of the tubular knitted fabric and a back side of the same by a flechage knitting.

4. The tubular knitted fabric according to claim 3, wherein the projection part is formed in an arbitrary shape and at an arbitrary location on the tubular knitted fabric by the flechage knitting.

5. The tubular knitted fabric according to claim 4, wherein the projection part is formed in an area of the tubular body extending in a course extending direction thereof and having a plurality of courses, one or more courses of said plurality have a different in number of stitches than another one or more courses of said plurality.

* * * * *